United States Patent [19]

Duncan

[11] Patent Number: 4,690,376

[45] Date of Patent: Sep. 1, 1987

[54] MAT TRANSPORT RACK

[75] Inventor: Neil Duncan, North Babylon, N.Y.

[73] Assignee: Olympia Sports Products, Inc., Plainview, N.Y.

[21] Appl. No.: 852,417

[22] Filed: Apr. 16, 1986

[51] Int. Cl.[4] ..... B66D 3/12; B66D 3/26

[52] U.S. Cl. ..... 254/327; 254/338; 414/911

[58] Field of Search ..... 254/324, 325, 327, 338; 211/44, 28; 414/910, 911, 538; 242/86.5 R, 86.52

[56] References Cited

U.S. PATENT DOCUMENTS

| | | | |
|---|---|---|---|
| 355,988 | 1/1887 | Gold | 211/44 |
| 698,338 | 4/1902 | Taylor | 254/324 |
| 2,135,540 | 11/1938 | Smith | 211/44 X |
| 2,994,939 | 8/1961 | Matthews | 254/338 X |
| 3,118,668 | 1/1964 | Callahan | 211/44 X |
| 3,494,492 | 2/1970 | Thiermann | 254/324 X |

FOREIGN PATENT DOCUMENTS

| | | | |
|---|---|---|---|
| 1427153 | 12/1965 | France | 211/44 |
| 299969 | 11/1928 | United Kingdom | 254/327 |

*Primary Examiner*—Stuart S. Levy
*Assistant Examiner*—Katherine Matecki
*Attorney, Agent, or Firm*—Hopgood, Calimafde, Kalil, Blaustein & Judlowe

[57] ABSTRACT

A stable movable metal frame mat transport rack useful for storing and transporting an entire three section wrestling mat. The rack contains a winch cable hoist mechanism for lifting and lowering the mat sections to and from storage positions on the rack.

1 Claim, 4 Drawing Figures

MAT TRANSPORT RACK

BACKGROUND OF THE INVENTION

The transport and storage of wrestling mats present problems for gymnasium facilities. These problems are largely due to the size and shape of the cumbersome mat sections. Conventional wrestling mats are divided into three sections. Each mat section when rolled has a length of about 14 to 15 feet and a diameter of about 32 to 40 inches. The mat sections are usually moved manually and require the use of considerable manpower. The rolled mat sections are also difficult to store since they are not easily stacked on each other and require a considerable amount of storage space.

Various devices such as dollies and ceiling storage systems have been developed in the past to alleviate the problems of moving and storing wrestling mats. The devices, however, are not useful for both transporting and storing the rolled wrestling mat sections. The present invention solves the problems of storing and transporting wrestling mats by providing a mat transport rack which can efficiently move and store an entire three section wrestling mat.

SUMMARY OF THE INVENTION

The present invention concerns a transport rack for storing and transporting a three section wrestling mat.

The rack is constructed of a first upright frame and a second upright frame connected in an opposed relationship by an upper hollow horizontal beam and a lower horizontal beam. The horizontal beams are substantially perpendicular to the frames and have a length, greater than the length of a rolled mat section.

Each of the frames has a long inclined member having a length corresponding to the length required to store two rolled mat sections and a short inclined member having a length corresponding to the length required to store one rolled mat section. The frames are positioned and configured so that the opposed long inclined members define a first inclined lifting plane and the opposed short inclined members define a second inclined lifting plan.

The inclined members have a plurality of support means for engaging a cylindrical member extending from the rolled mat section. The support means are positioned along the length of the long inclined members so as to define a first upper storage location for a rolled mat section and a second lower storage location for a rolled mat section along the first lifting plane. The support means are positioned along the length of the short inclined members so as to define a third storage location along the second lifting plane at substantially the same level as the second storage location.

The first frame has a winch means mounted thereon, which is connected to a short cable and a long cable. Each cable terminates in a hook means for engaging the cylindrical members extending from the rolled mat sections.

The short cable is mounted on a first pulley means positioned adjacent to the first frame and thereafter extends downwardly along the first frame. The long cable is mounted on a second pulley means coupled to the first pulley means and extends through the upper horizontal beam is to a third pulley means positioned adjacent to the second frame and thereafter extends downwardly along the second frame.

The winch means is operable to lift mat sections coupled to the cables along the first lifting plane to the first and second storage positions and along the second lifting plane to the third storage position.

DETAILED DESCRIPTION OF THE PREFERRED EMBODIMENT

Figure 1:
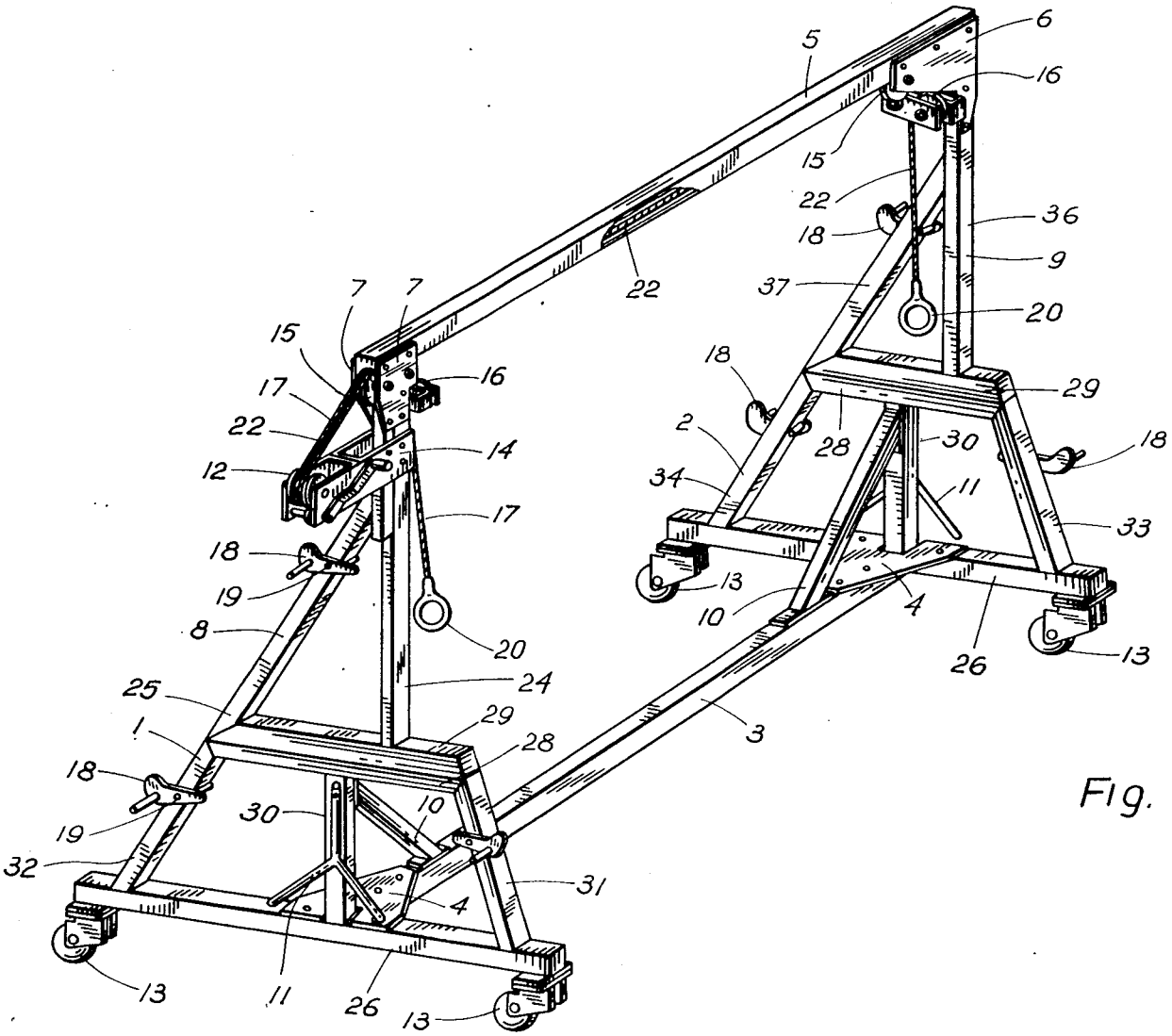
FIG. 1 is a perspective view of the mat transport rack.
Figure 2:
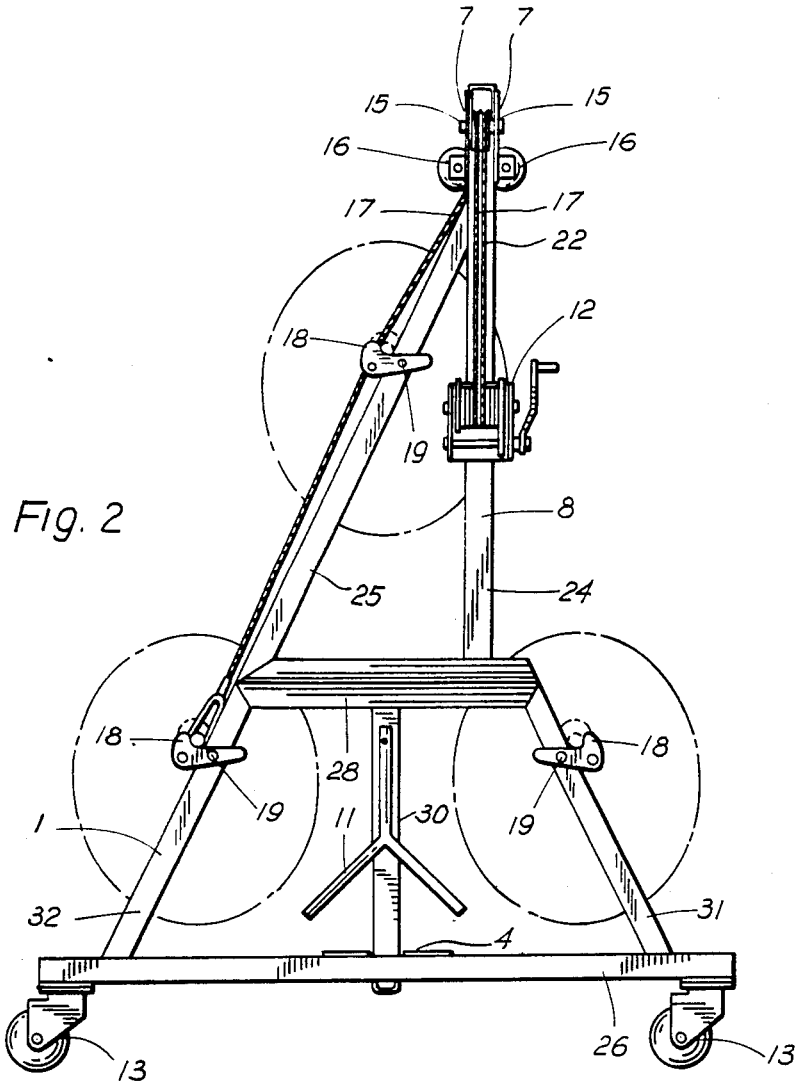
FIG. 2 is a side and elevation view of the winch side of the mat transport rack.
Figure 3:
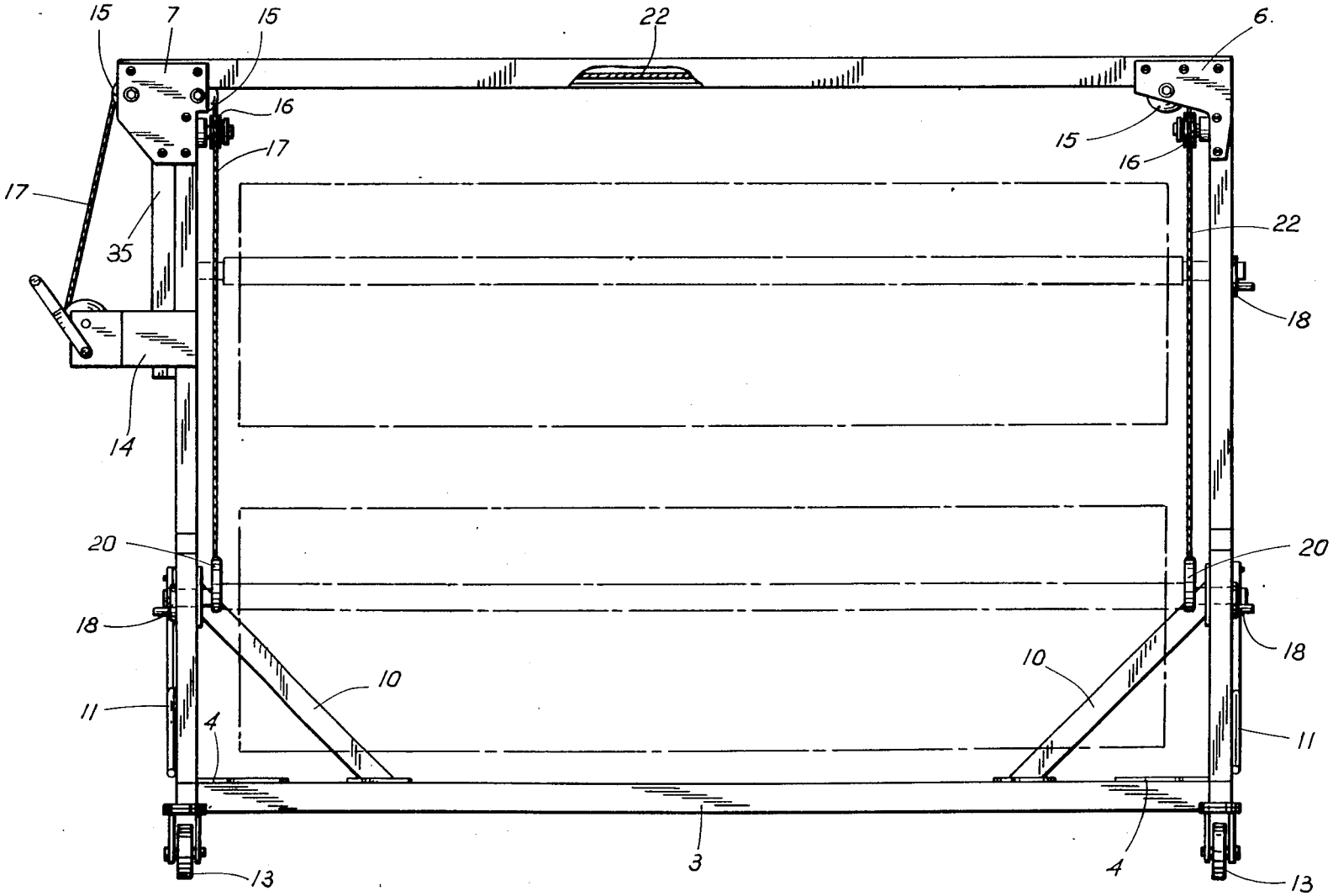
FIG. 3 is a front and elevation view of the mat transport rack.
Figure 4:
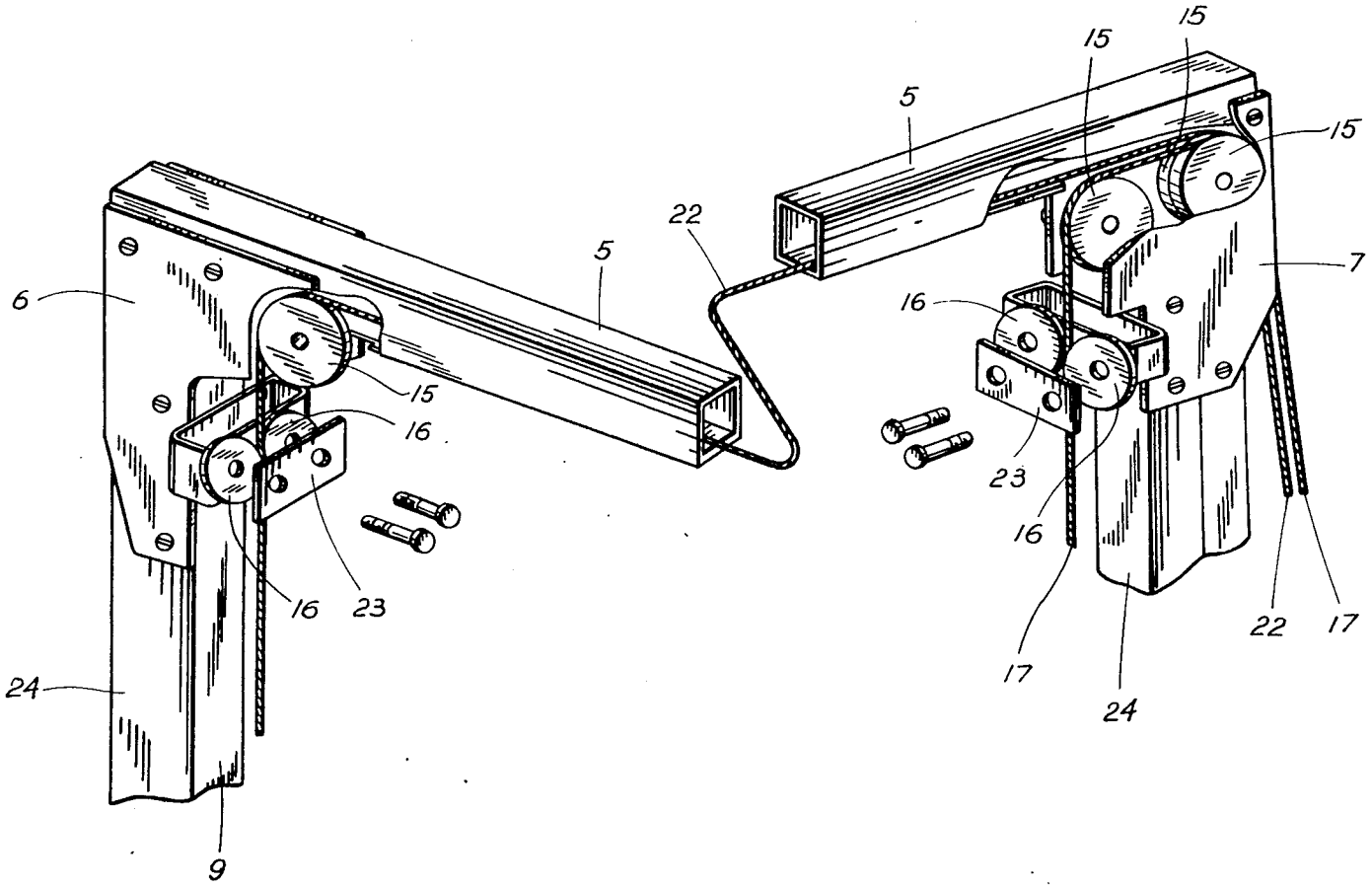
FIG. 4 is a detail view of the top portion of the transport rack showing the assembly of the pulley and cable hoist mechanism.

In a preferred embodiment of the invention the transporter rack is assembled in two sections, an upper section and a lower section. The rack can be constructed from any suitable metal. In the preferred embodiment the rack is constructed from galvanized 14 gauge steel tubing.

Referring to the Figures, the lower section is composed of a winch side lower brace assembly, 1, and a farside lower brace assembly, 2, connected by a lower horizontal beam, 3.

Each lower brace assembly is substantially trapezoidal in configuration. The base of the lower brace assembly is formed by a long lower frame horizontal bar, 26. Caster wheels, 13, are attached to the horizontal bar, 26. Each horizontal bar, 26, is attached to an inclined lower frame front diagonal bar, 32 and 34, and an inclined lower frame back diagonal bar, 31 and 33. The top ends of the diagonal bars, 31 and 32 and 33 and 34, are joined by a lower frame short horizontal bar, 28, thus forming a trapezoidal configuration. The lower horizontal bar, 26, and the upper horizontal bar, 28, are joined substantially about their midsection by a lower frame vertical bar, 30. Optionally, two lifting handles, 11 are attached to the vertical bar, 30. These lifting handles can be used to manually lift the mat sections by inserting one prong of the lifting handle into a hollow cylinder around which the mat section is rolled. Lifting tube holder plates, 18, are attached to each of the lower frame diagonal bars 31, 32, 33 and 34 using collars and set screws, 19. The holder plates, 18, support the cylindrical lifting tube inserted in and extending from the rolled mat section. The four holder plates, 18, on the lower section thus define two mat section storage positions on the lower section.

The lower horizontal bar, 3, is attached to each lower brace assembly, 1, 2 by means of flat connecting fish plates, 4, and lower diagonal stiffener bars, 10. The flat connecting fish plates, 4, are configured and dimensioned so that the notch of each plate fits around the lower frame vertical bar, 30. The plates are attached to the lower frame long horizontal bar, 26. The diagonal stiffener bars, 10, are attached to the lower frame vertical bars, 30, at a position adjacent to the lower frame short horizontal bar, 28, and to the lower horizontal beam 3, at a position adjacent to the edge of the plates, 4.

The upper section comprises two triangular upper frame sections, an upper winch side frame, 8, and an upper far side frame, 9, connected by a hollow upper horizontal beam, 5. Each upper frame consists of an upper frame horizontal bar, 29, attached to a upper frame vertical bar, 24 and 36. The upper frame diagonal bars, 25 and 37 are attached to and extend upward from the horizontal bar, 29, and are thereafter attached to the upper frame vertical bars, 24 and 36 at a point below the edge of the connecting plates, 6 and 7. The upper frames are attached to the lower frames by connecting the upper frame horizontal bars, 29, to the lower frame short horizontal bars, 28. When the frames are attached the upper frame diagonal bars, 25 and 37, and the lower frame diagonal bars, 32 and 34 form a contiguous inclined lifting plane. Holder plates, 18, are attached to the upper diagonal bars, 25 and 37, at substantially the same level thus defining a third mat section storage position. The upper horizontal beam, 5, connected to the winch side vertical bar, 24, by two winch side connecting plates, 7, and to the vertical bar on the side opposite the winch, 36, by two far side connecting plates, 6.

The short vertical bar, 35, is attached to the top part of the vertical bar, 24, on the winch side of the upper frame, 8. The two adjacent attached vertical bars, 24 and 35, form the base to the winch mounting bracket, 14, is attached. A hand winch means, 12, is connected to the mounting bracket, 14. The winch means, 12, operates the hoist mechanism which lifts and lowers the mat sections to and from the three storage positions. The remainder of the hoist mechanism is comprised of a long cable means or wire rope, 22, a short cable means, 17, four large diameter pulleys, 15, and four small diameter guide pulleys, 16.

Three of the large pulleys, 15, are positioned between the two connecting plates, 7, on the winch side of the upper frame. Two of the large pulleys are coupled in a position above the vertical bar, 35, on the winch side on the upper frame. The short cable, 17, extends from the winch drum and is mounted on one of these pulleys and the long cable, 22, is mounted on the other. The third large pulley, 15, on the winch side is positioned substantially in line with the pulley on which the short cable is mounted. The short cable is also mounted on the third pulley and thereafter extends downwardly along the vertical bar between the two small guide pulleys, 16. The guide pulleys, 16, are attached to the vertical bar, 24 by bracket means and have a support bended plate, 16, attached to their outside face in order to keep the cables, 17, 22 within the guide pulley mechanism. The long cable, 22, extends from the winch drum and is mounted on the coupled pulley, 15, which does to contain the short cable, 17. Thereafter the long cable, 22, extends through the upper horizontal beam, 5, to the fourth large pulley, 15, positioned between the connecting plates, 6, on the far side of the upper frame. The long cable, 22, is mounted on the fourth large pulley, 15, and thereafter extends downwardly along the vertical bar, 36, between the two small guide pulleys, 16. The guide pulleys are attached to the vertical bar, 36, by bracket means and have a support bended plate, 23, attached to their outside face to keep the cable within the guide pulley mechanism.

The long and short cables, each have a hook or a sling, 20, for engaging a cylindrical tube upon which the mat sections are rolled and which extends from the sides of the sections. The cables are of suitable lengths such that the cables downwardly extend to substantially the same position relative to the transport rack frame. The winch and hoist mechanism is operable to lift and lower mat sections to and from the three mat storage positions on the transport rack.

Although the invention has been described with reference to a particular illustrative embodiment, numerous modifications additions and other changes can be made to the present invention without departing from the scope and the spirit thereof. Any such changes are meant to be within the scope of the invention as set forth in the claims.

What is claimed is:

1. A transport rack for storing and transporting a three section wrestling mat comprising:

a first upright frame and a second upright frame connected in parallel by an upper hollow horizontal beam and a lower horizontal beam; the horizontal beams being substantially perpendicular to the frames and having a length greater than the length of a rolled mat section;

the frames having a long inclined member having storage locations for two rolled mat sections and a short inclined member having a storage location for one rolled mat section, the long inclined member being at least twice the length of the short inclined member, the frames being positioned and configured so that the long inclined members define a first inclined lifting plane and the short inclined members define a second inclined lifting plane;

the inclined members having a plurality of support means for engaging a cylindrical member extending from the rolled mat section, two support means positioned along the length of each of the long inclined members so as to define a first upper storage location for a rolled mat section and a second lower storage location for a rolled mat section along the first lifting plane, one support means positioned along the length of each of the short inclined members so as to define a third storage location along the second lifting plane at substantially the same level as the second storage location;

the first frame having a winch means mounted thereon, the winch means being connected to a short cable and a long cable, each cable terminating in a hook means for engaging the cylindrical members extending from the rolled mat sections;

the short cable being mounted on a first pulley means positioned adjacent to the first frame and thereafter extending downwardly between two guide pulleys attached to the first frame along the first frame;

the long cable being mounted on a second pulley means coupled to the first pulley means and thereafter extending through the upper horizontal beam and being mounted on a third pulley means positioned adjacent to the second frame and extending downwardly between two guide pulleys attached to the second frame along the second frame;

the winch means being operable to lift mat sections coupled to the cables along the first lifting plane to the first and second storage positions and along the second lifting plane to the third storage position.

* * * * *